US009656309B2

(12) United States Patent
Hedlund et al.

(10) Patent No.: US 9,656,309 B2
(45) Date of Patent: May 23, 2017

(54) ARRANGEMENT AND VENTILATION ARRANGEMENT

(75) Inventors: Lars Hedlund, Skellefteå (SE); Lars Karlander, Skellefteå (SE)

(73) Assignee: Fumex AB, Skelleftea (SE)

( * ) Notice: Subject to any disclaimer, the term of this patent is extended or adjusted under 35 U.S.C. 154(b) by 946 days.

(21) Appl. No.: 13/635,666

(22) PCT Filed: Mar. 15, 2011

(86) PCT No.: PCT/SE2011/050283
§ 371 (c)(1),
(2), (4) Date: Nov. 26, 2012

(87) PCT Pub. No.: WO2011/115558
PCT Pub. Date: Sep. 22, 2011

(65) Prior Publication Data

US 2013/0203331 A1 Aug. 8, 2013

(30) Foreign Application Priority Data

Mar. 18, 2010 (SE) ..... 1050254

(51) Int. Cl.
*B08B 15/04* (2006.01)
*B08B 15/00* (2006.01)
*F24F 13/02* (2006.01)

(52) U.S. Cl.
CPC ..... *B08B 15/04* (2013.01); *B08B 15/00* (2013.01); *F24F 13/0254* (2013.01)

(58) Field of Classification Search
CPC ..... B08B 15/04
(Continued)

(56) References Cited

U.S. PATENT DOCUMENTS 4,881,843 A * 11/1989 Randleman ..... 403/92
4,902,315 A * 2/1990 Spicer ..... 95/273
(Continued)

FOREIGN PATENT DOCUMENTS

DE 3225953 A1 1/1984
EP 0567442 A1 10/1993
SE 506838 C2 2/1998

OTHER PUBLICATIONS

International Search Report and Written Opinion received for PCT Patent Application No. PCT/SE2011/050283, mailed on Jun. 10, 2011, 11 pages.
(Continued)

*Primary Examiner* — Avinash Savani
*Assistant Examiner* — Vivek Shirsat
(74) *Attorney, Agent, or Firm* — Morrison & Foerster LLP

(57) ABSTRACT

This invention concerns an arrangement 1 intended to be used in a ventilation arrangement in order to hold and control an air channel 2. The arrangement 1 comprises a single arm construction 1.1 that is arranged along the outer surface 2A of the air channel. The arm construction 1.1 comprises two arm sections 3 and 4 arranged one after the other, a first joint 5 that unites a first arm part 3 with a fixture arrangement 6 that holds and maintains the basic position of the arm construction 1.1 and that makes possible different positioning, bending and stretching, of the arm construction 1.1 and the air channel 2, a second joint 7 that unites the first arm section 3 with the second arm section 4 and that makes possible different positioning, bending and stretching, of the arm construction 1.1 and the air channel 2. Each arm section 3 and 4 comprises an extended aluminum profile 8 and 9. The invention concerns also a ventilation arrangement comprising such an arrangement 1.

27 Claims, 11 Drawing Sheets

(58) Field of Classification Search
USPC ..... 454/63, 333, 65, 67; 409/92, 93
See application file for complete search history.

(56) References Cited

U.S. PATENT DOCUMENTS

| | | | | |
|---|---|---|---|---|
| 5,159,737 | A * | 11/1992 | Kimura | B67D 7/00 15/312.1 |
| 5,427,569 | A * | 6/1995 | Plymoth | 454/65 |
| 5,527,217 | A * | 6/1996 | Engstrom | 454/63 |
| 5,536,206 | A * | 7/1996 | Bodmer et al. | 454/65 |
| 6,092,778 | A * | 7/2000 | Lang et al. | 248/478 |
| 7,954,779 | B2 * | 6/2011 | Coral et al. | 248/280.11 |
| 8,146,887 | B1 * | 4/2012 | Amirian et al. | 251/306 |

OTHER PUBLICATIONS

International Preliminary Report on Patentability received for PCT Patent Application No. PCT/SE2011/050283, completed on Jun. 12, 2012, 4 pages.

* cited by examiner

ARRANGEMENT AND VENTILATION ARRANGEMENT

CROSS REFERENCE TO RELATED APPLICATIONS

This is a U.S. National Phase patent application of PCT/SE2011/050283, filed Mar. 15, 2011, which claims priority to the Swedish Patent Application No. 1050254-0, filed Mar. 18, 2010, each of which is hereby incorporated by reference in the present disclosure in its entirety.

TECHNICAL AREA

This invention concerns an arrangement intended to be used in a ventilation arrangement in order to hold and control an air channel. The invention concerns also a ventilation arrangement comprising such an arrangement.

BACKGROUND AND PROBLEM

Arrangements that can be used at ventilation arrangements in order to hold and control a channel through which air and thus hazardous substances and gases may be withdrawn are known. The term "ventilation arrangement" is here used to denote all parts and fittings that constitute the ventilation arrangement, and this arrangement also comprises, among other parts, a unit that can create negative pressure, a force of suction, that acts on the air in the flexible channel and various parts and constructions that lead, distribute, retain, guide, regulate and in other ways ensure that the ventilation arrangement works in the manner desired. These arrangements are relatively heavy constructions manufactured from steel. They are heavy to transport and assemble, they become difficult to manoeuvre, and thus they require a lot of space in use.

DESCRIPTION OF THE INVENTION

One purpose of the present invention is to offer an arrangement that is to be used at ventilation arrangements in order to hold and control an air channel and which is of light construction, and to offer a ventilation arrangement comprising such an arrangement.

This purpose is achieved with an arrangement comprising the technical characteristics that are specified in the characterising part of claim 1 and a ventilation arrangement according to claim 31.

DETAILED DESCRIPTION OF EMBODIMENTS

Figure 1:
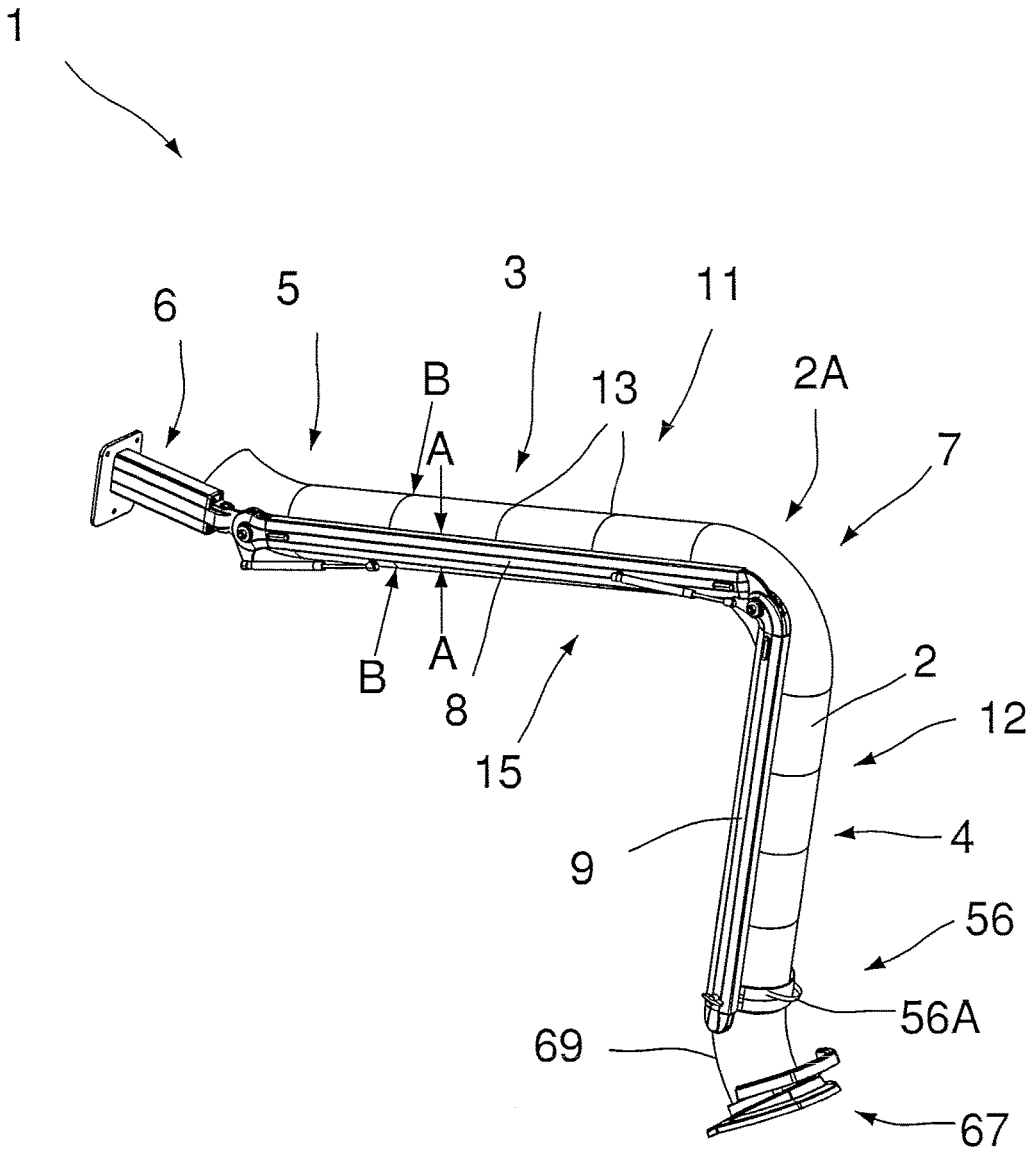
FIG. 1 shows an arrangement according to the invention.

The Arm Construction:

This invention concerns an arrangement 1 intended to be used in a ventilation arrangement in order to hold and control an air channel 2. The air channel 2 is intended for the extraction of air and at least one of undesired particles and gases from various places, normally working areas of various types. The air channel 2 is connected to a unit, not shown in the drawings, that creates negative pressure in the flexible channel 2, a force that withdraws air.

The arrangement 1 comprises one single arm construction 1.1, which is arranged along the outer surface of the air channel 2A.

An arm construction 1.1 according to the invention and shown in FIG. 1 comprises two arm sections 3 and 4, two linkage arms, a first arm section 3 and a second arm section 4, arranged one after the other. The arm construction 1.1 further comprises a first joint 5, a friction joint, that unites the first arm section with a fixture arrangement 6 that holds and sets the basic position of the arm construction and that makes possible different positioning, bending and stretching, of the arm construction 1.1. The arm construction 1.1 further comprises a second joint 7, a friction joint, that unites the first arm section 3 with the second arm section 4 and that makes possible different positioning, bending and stretching, of the arm construction 1.1.

Each arm section 3 and 4 comprises an aluminium profile 8 and 9 that is extended, and should appropriately be manufactured by extrusion, see FIG. 1. Each arm section 3 and 4 is mainly constituted by the aluminium profiles 8 and 9 in the central part that gives the arm section its longitudinal extension.

The arrangement 1 will be light in its construction, and this means that it is easy to displace it during transport, during assembly and during use, and thus also when displacing the arrangement 1 and an air channel 2 together, since the arrangement 1 comprises only a single arm construction 1.1 with arm sections 3 and 4 that comprise an aluminium profile 8 and 9. The use of aluminium makes the construction lighter than arrangements with arm sections of steel.

The use of aluminium also makes it possible to make the arrangement 1, the arm construction 1.1, more gracile and more attractive than arrangements with arm sections of steel, since parts made from aluminium, as a consequence of the properties of the material, can be formed in different ways and can be made smaller than components of steel while remaining just as stable and more attractive in their form.

The fact that the arm construction 1.1 is lighter, smaller and more attractive makes it possible to arrange the arm construction 1.1 fully visible on the outer surface of the air channel 2A. This makes manufacture, transport and assembly easier, since components can be manufactured and delivered separately, to be assembled on site. The use and the adaptation of the arm construction 1 is also made easier, since an air channel 2 that is suitable for the purpose can be used. It becomes possible to use the same arm construction 1 in different contexts simply by exchanging the air channel 2.

It becomes easier also to adjust and repair the arm construction 1.1 when it is not concealed inside an air channel. It is possible also to see and interpret the arm construction 1.1 based on its function such that it becomes easier to use the arrangement 1.

The air channel 2 is flexible, it can be bent, at least at those parts that are coincident in location with the joints 5 and 7. The air channel 2 may be constituted by or it may comprise a tube or more rigid parts.

Figure 2:
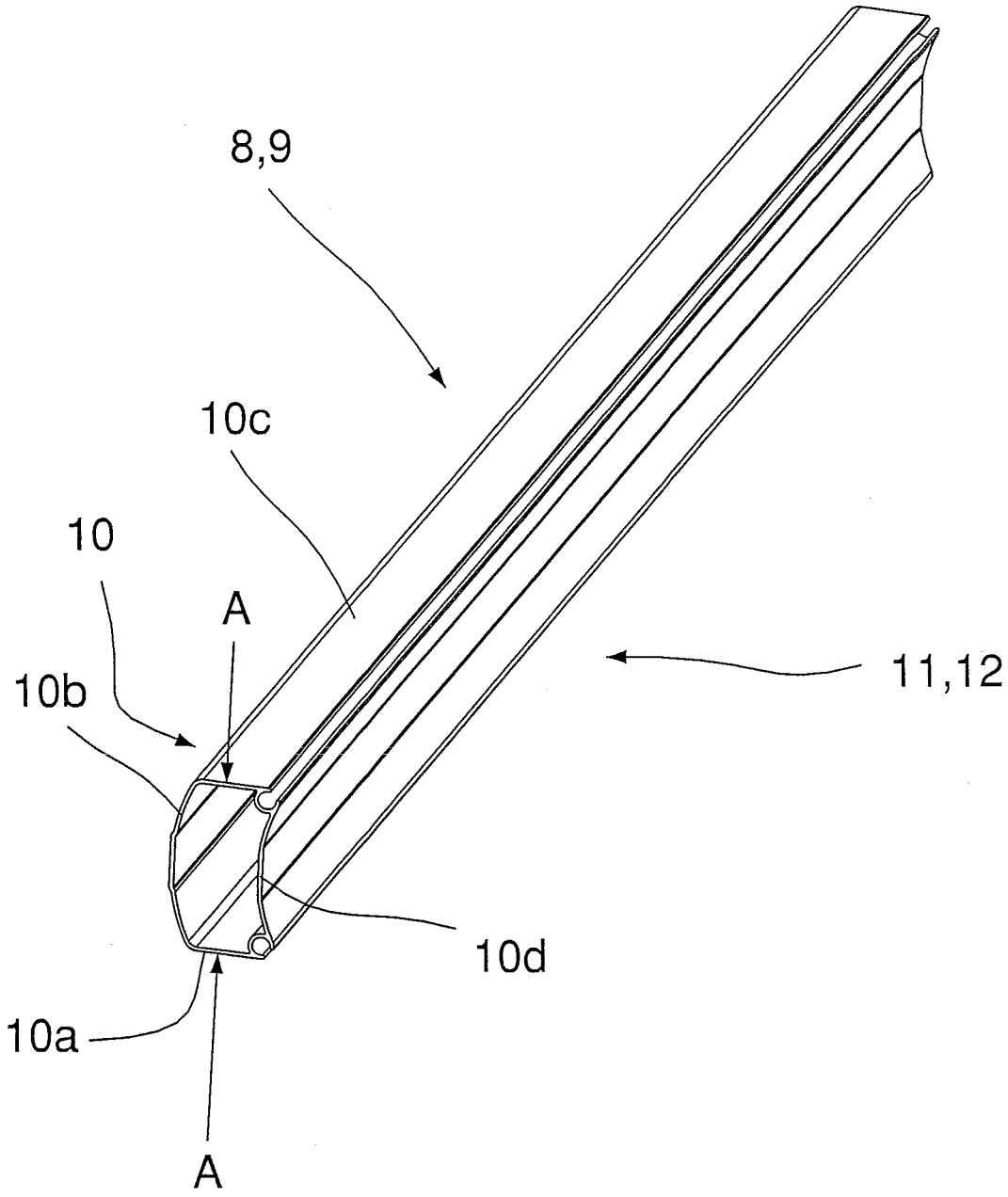
FIG. 2 shows a section A through an arrangement, an arm construction, an arm section, according to the invention.

The aluminium profile 8 or 9 of each arm section is, in the embodiment shown, a hollow profile, see FIG. 2, which comprises at least four side sections 10*a*-10*d*.

Figure 3:
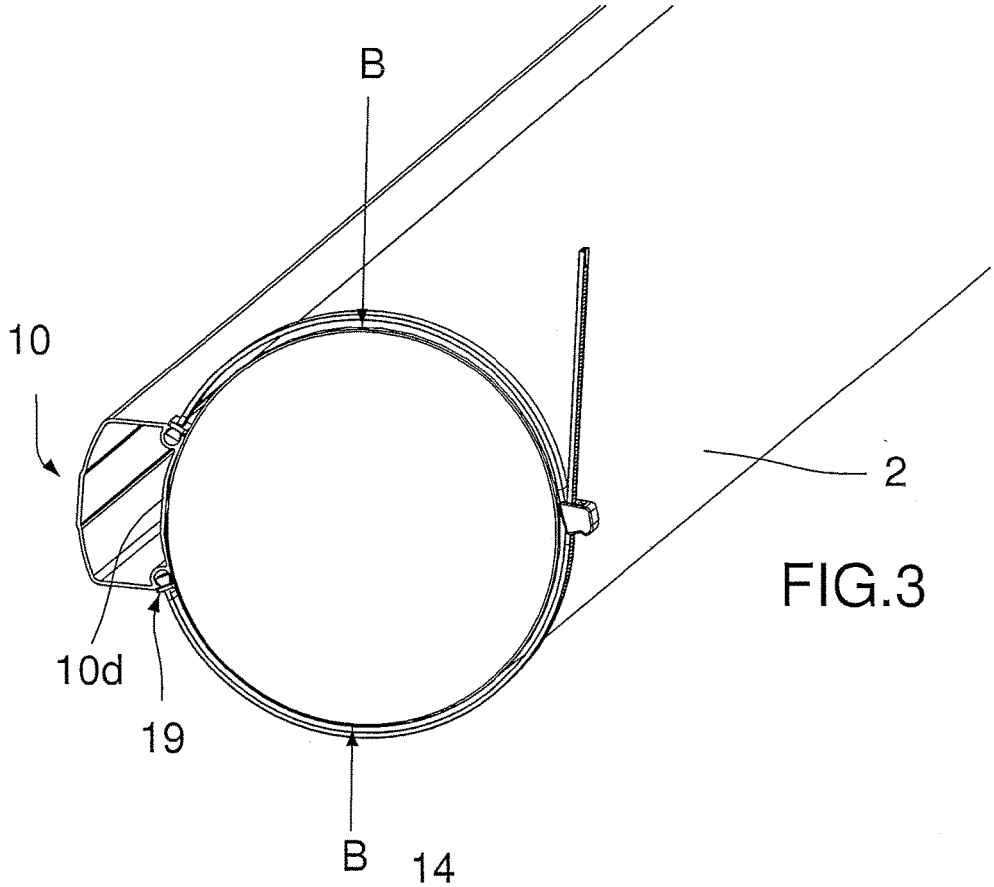
FIG. 3 shows a section B through an arrangement, an arm construction, an arm section, according to the invention.

Each arm section 3 and 4 comprises a side 11 and 12, respectively, an outer surface that faces the air channel 2, a side section 10*d* that has an exterior that is formed to support the air channel 2 that lies exterior to the arm construction 1, see FIG. 3.

It is appropriate that the air channel 2 be principally circular, and one side 11, 12, and 10*d* of each arm section have an exterior concave design that corresponds to the outer form of the channel, its convex form, in order to give maximum support to the air channel.

The Fixture Arrangement

Figure 4:
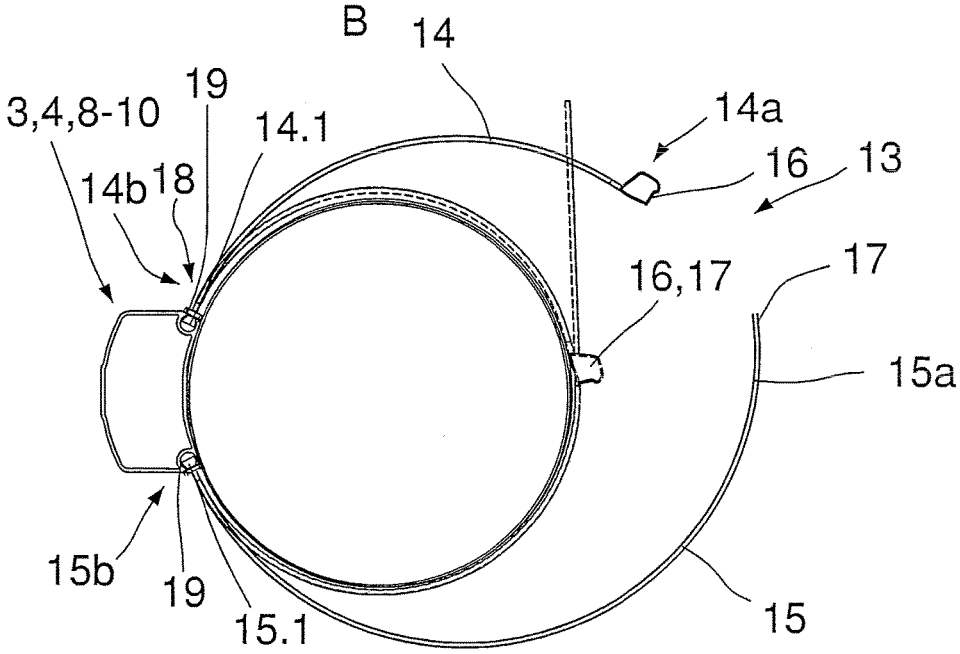
FIG. 4 shows a section B through an arrangement, an arm construction, an arm section, and an fixture arrangement according to the invention.

The arrangement 1 comprises a fixture arrangement 13 that fixes, retains in place, the flexible channel 2 at the arm construction 1.1, see FIGS. 1 and 4. The arm construction 1.1 and the air channel 2 run parallel next to each other, side by side. The fixture arrangement 13 comprises means 14 and 15 that are united with each arm section 3 and 4, on the outer surface of each arm section 3 and 4, and that are held in tension around the air channel 2.

One of these means 14 comprises a free end 14*a* that comprises a first locking part 16, while the second of these means 15 comprises a free end 15*a* that comprises a second locking part 17 and where the two locking parts 16 and 17 are brought into locking interaction with each other in order to retain the air channel 2 in place. A locked condition is shown in FIG. 4 with dashed lines.

The means 14 and 15 are, in the embodiment shown, tension bands of cable tie type where the first locking part 16 or 17 comprises a protruding part and where the second locking part 16 or 17 comprises a hole or a cavity and where the protruding part 16 and the hole, the cavity, 17 have mutually complementary designs in order to achieve a locking function.

The fixture arrangement 13 comprises a fixture 18 on each arm section 3 and 4 that unites the means 14 and 15 with the relevant arm section 3 and 4. The fixture 18 comprises at least one track 19 that runs along the arm section 3 or 4 and into which a means 14 or 15, or parts 14.1 and 15.1 of the means, are arranged. The fixture 18 that is shown in the drawings comprises two parallel tracks 19 that run parallel along each arm section 3 and 4 and in which the means 14 and 15, or parts 14.1 and 15.1 of the means, the fixture bands, are arranged. Each track 19 and each means 14 or 15 have complementary designs in such a manner that one end 14*b* or 15*b* of the means can be introduced into the track 19 from one end of the arm 3*a*, 3*b*, 4*a* or 4*b*, the end of the track, and displaced along the track to the desired location.

Figure 5:
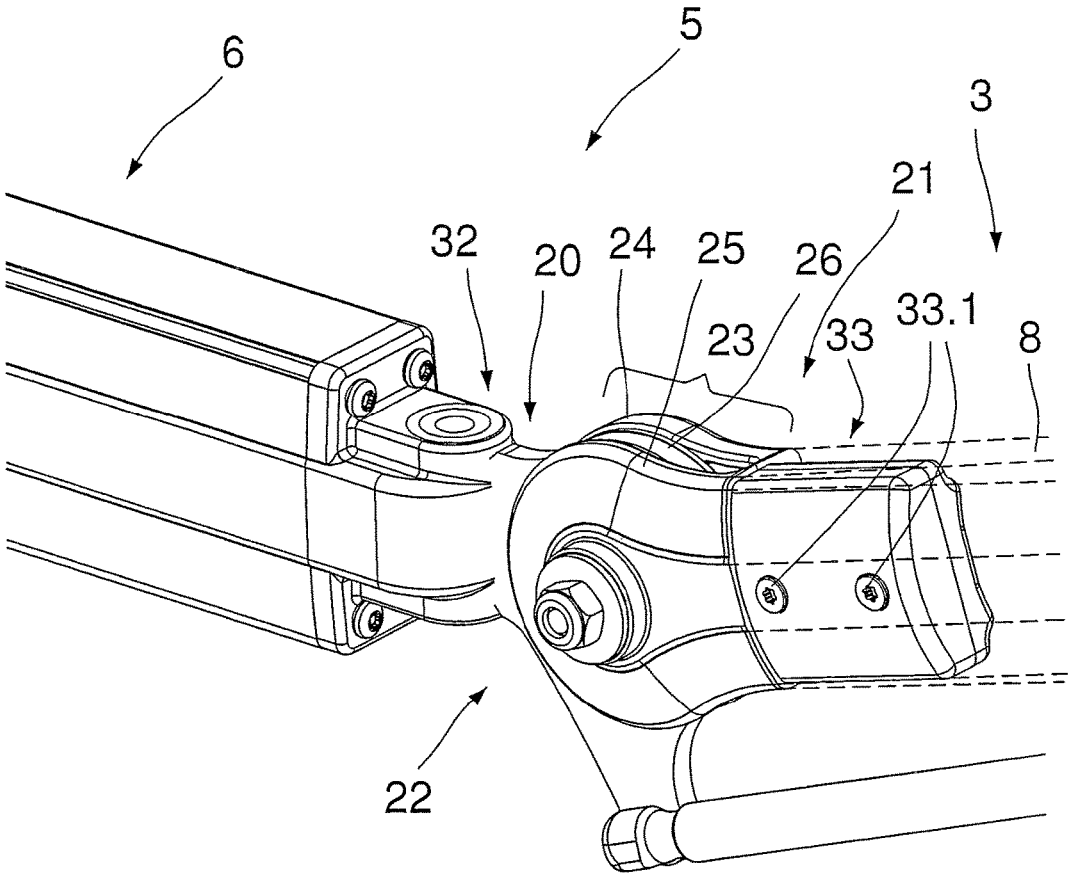
FIG. 5 shows a first joint according to the invention.
Figure 6:
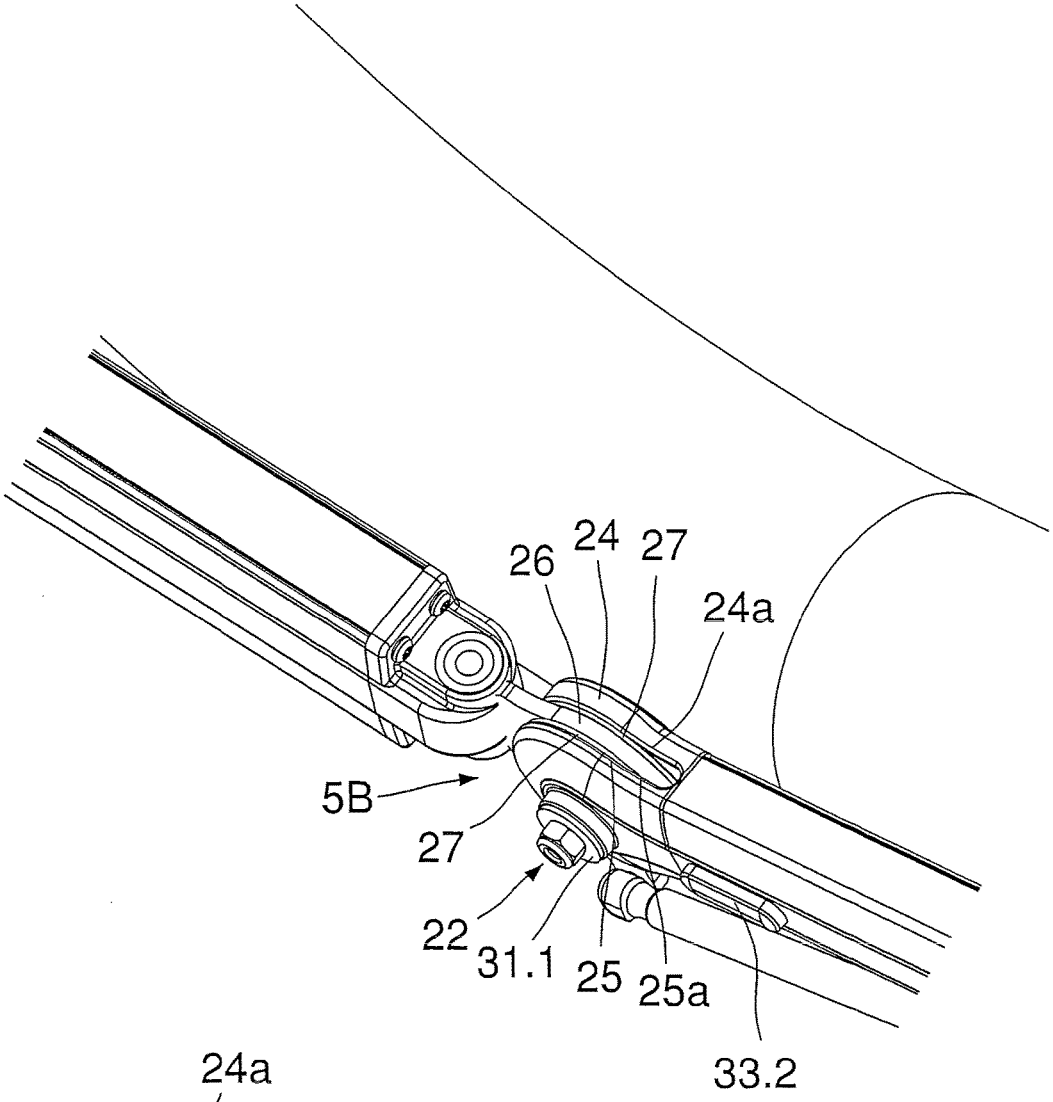
FIG. 6 shows a first joint according to the invention.

The First Joint:

The first joint 5 comprises a first part 20 united with a fixture arrangement 6 and a second part 21 united with the first arm section 3. The parts 20 and 21 of the joint are united with each other through a shaft 22 that passes through the first part of the joint 20 and the second part of the joint 21, around which shaft the first part of the joint 20 and the second part of the joint 21 can be rotated relative to each other. See FIGS. 5 and 6.

Figure 7:
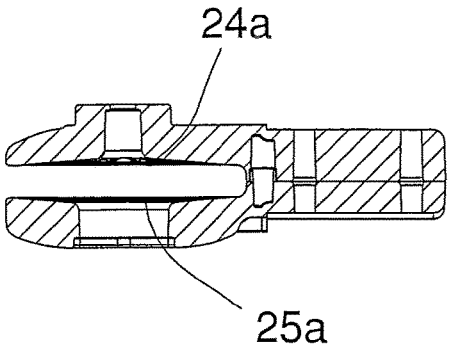
FIG. 7 shows a surface of a joint component in a first joint according to the invention.

One of the parts of the joint 20 and 21, in this case the part of the joint 21, comprises a cradle-shaped part 23, comprising two parts 24 and 25 arranged parallel to each other and separated by a certain distance, these parts being in turn arranged on each side of a plane part 26 that is comprised within the second part of the joint 20. The two parallel parts 24 and 25 each comprises a friction surface 27 arranged on the surface 24*a* and 25*a* of the relevant part that is facing the plane part 26 of the second part of the joint. The parallel parts 24 and 25 and the relevant surface 24*a* and 25*a* that is facing the plane part 26 of the second part of the joint have concave surface forms, see FIG. 7.

Figure 8:
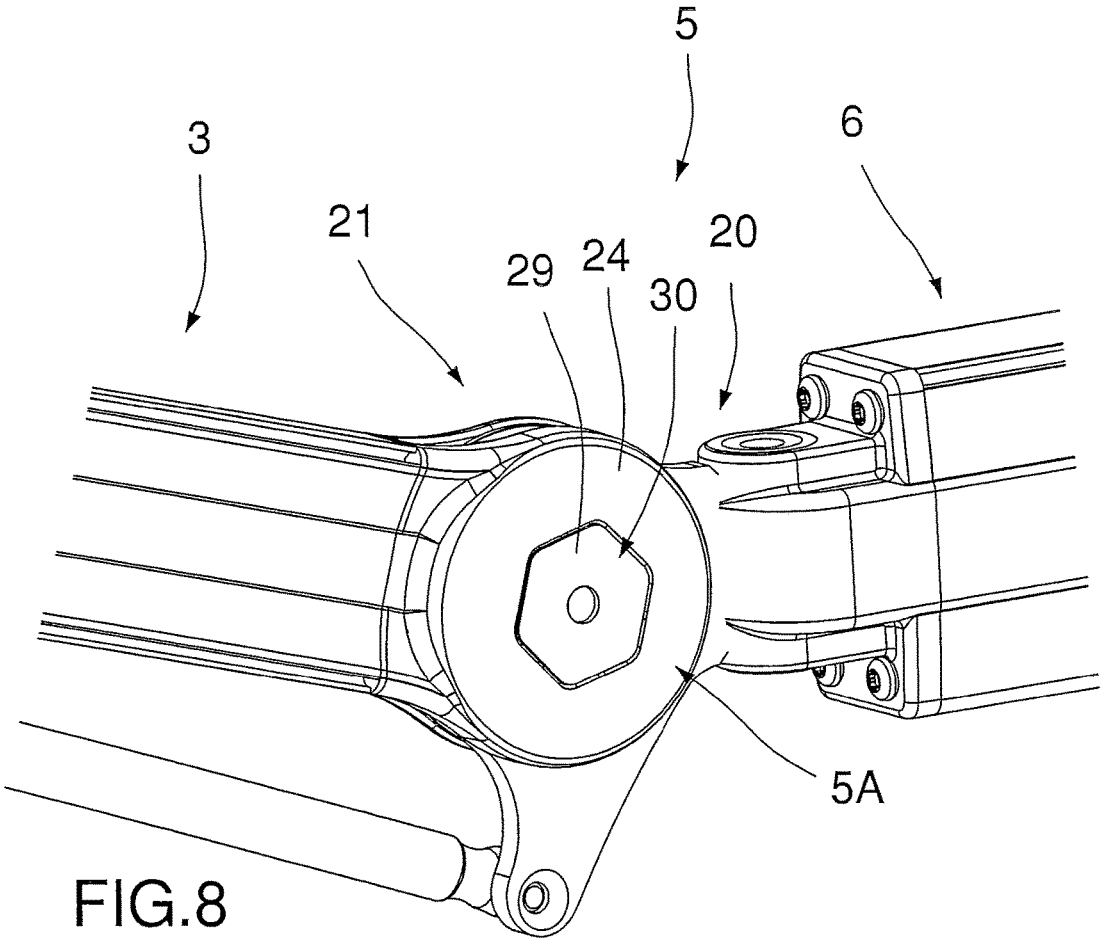
FIG. 8 shows a first joint according to the invention.
Figure 9:
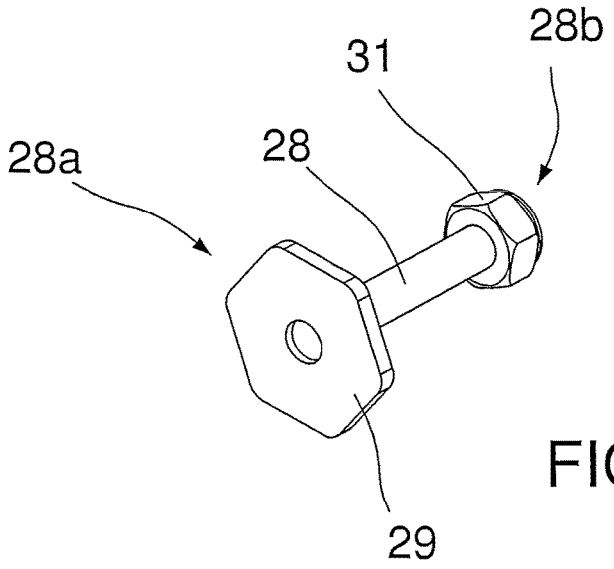
FIG. 9 shows a shaft in a first joint according to the invention.

The shaft 22 in the first joint 5 comprises a screw 28 that passes through the first part of the joint 20 and the second part of the joint 22, which screw at one end 28*a* comprises an enlarged edged head 29, a hexagonal head, that when in its assembled condition is arranged in an indentation 30 that coincides in form in one side 5A of the joint in order to achieve fixed contact with the joint 5 and in order to achieve distribution of the force that holds the joint together over a large part of the surfaces 24*a* and 25*a* of the parts of the joint. See FIGS. 8 and 9.

The shaft 22 comprises a nut 31 that is screwed onto the threaded second end 28*b* of the screw and where a washer 31.1 that distributes force is arranged between the nut 31 and the second side 5B of the joint.

The two parts 20 and 21 of the first joint are manufactured from a polymer material and are manufactured by casting in a mould.

The first part 20 of the first joint comprises a part 32 that protrudes from the joint 5 and that is mounted at the fixture arrangement 6. See FIG. 5. The first part 20 of the first joint may, alternatively, constitute a part of the fixture arrangement 6. The first part may, in this case, be manufactured from a steel material. The first part 20 may comprise also an inner part of steel covered by a polymer material.

The second part 21 of the first joint comprises a part 33 that protrudes from the first joint 5 and that makes it possible to assemble the second part 21 with the first arm section 3.

The part 33 has a form that makes it possible to insert the part 33 into the profile 8 of the first arm section and attach it with the aid of fixture means 33.1, screws or bolts that pass through, into the arm section 3. The fixture means 33.1, the bolts, are covered with the aid of a cover 33.2.

Figure 10:
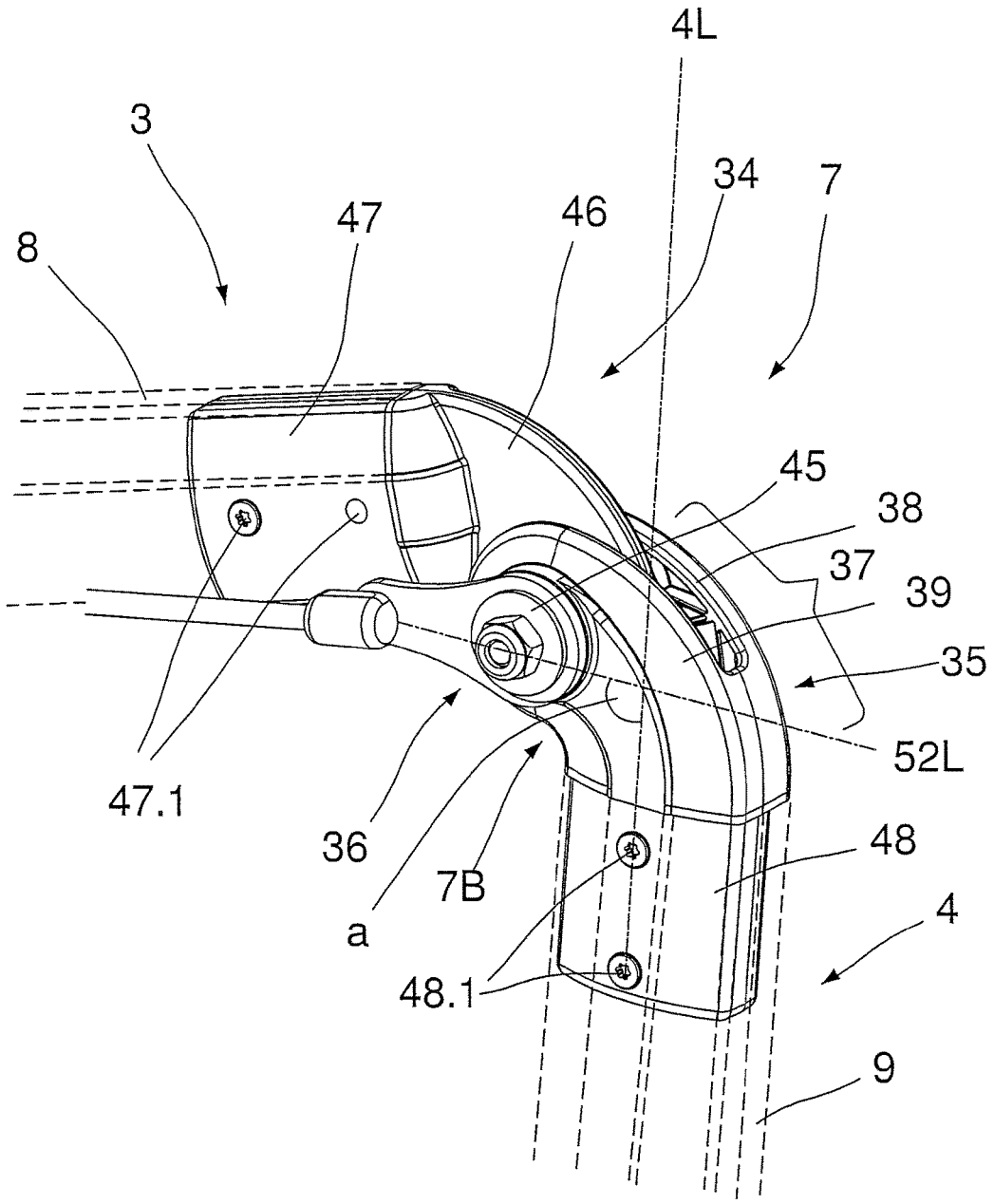
FIG. 10 shows a second joint according to the invention.

The Second Joint:

The second joint 7 of the arrangement, of the arm construction, which is a friction joint, comprises a first part 34 united with the first arm section 3 and a second part 35 united with the second arm section 4. The parts 34 and 35 of the joint are united with each other through a shaft 36 that passes through the first part of the joint 34 and the second part of the joint 35, around which shaft the first part of the joint 34 and the second part of the joint 35 can be rotated relative to each other. See FIG. 10.

Figure 11:
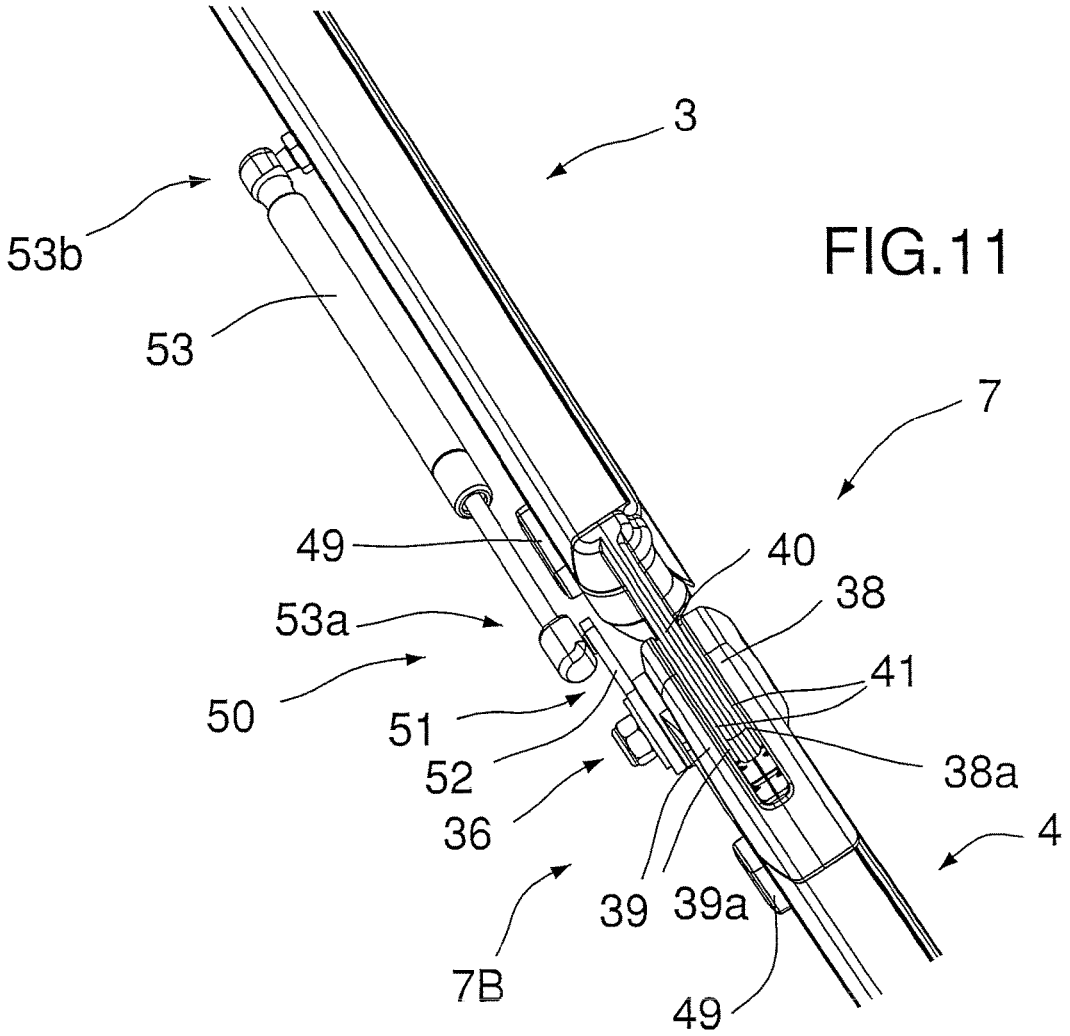
FIG. 11 shows a second joint according to the invention.

One of the parts of the joint 34 or 35, in the embodiment shown this is the part of the joint 35, comprises a cradle-shaped part 37, comprising two parts 38 and 39 arranged parallel to each other and separated by a certain distance, these parts being in turn arranged on each side of a plane part 40 that is comprised within the second part of the joint 34. See FIG. 11. The two parallel parts 38 and 39 comprise a friction surface 41 arranged on the surface 38*a* and 39*a* of the relevant part that is facing the plane part 40 of the second part of the joint. The parallel parts 38 and 39 and the relevant surface 38*a* and 39*a* that is facing the plane part 40 of the second part of the joint have concave surface forms. See the corresponding form of the surfaces 24*a* and 25*a* of the first joint in FIG. 7.

Figure 12:
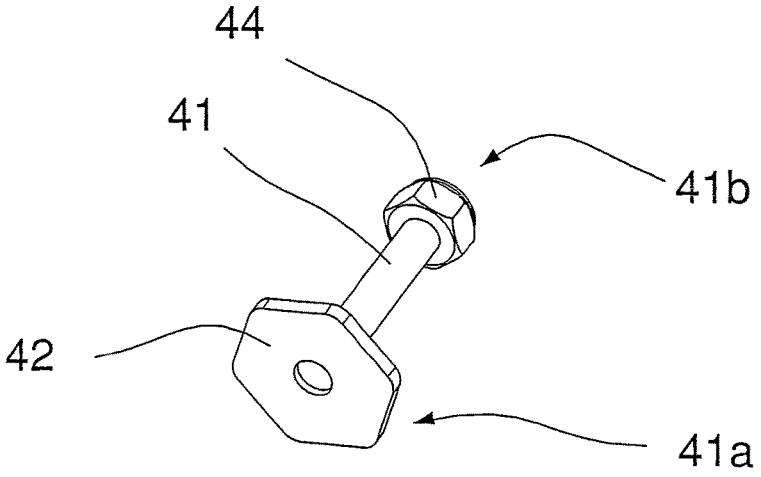
FIG. 12 shows a shaft in a second joint according to the invention.
Figure 13:
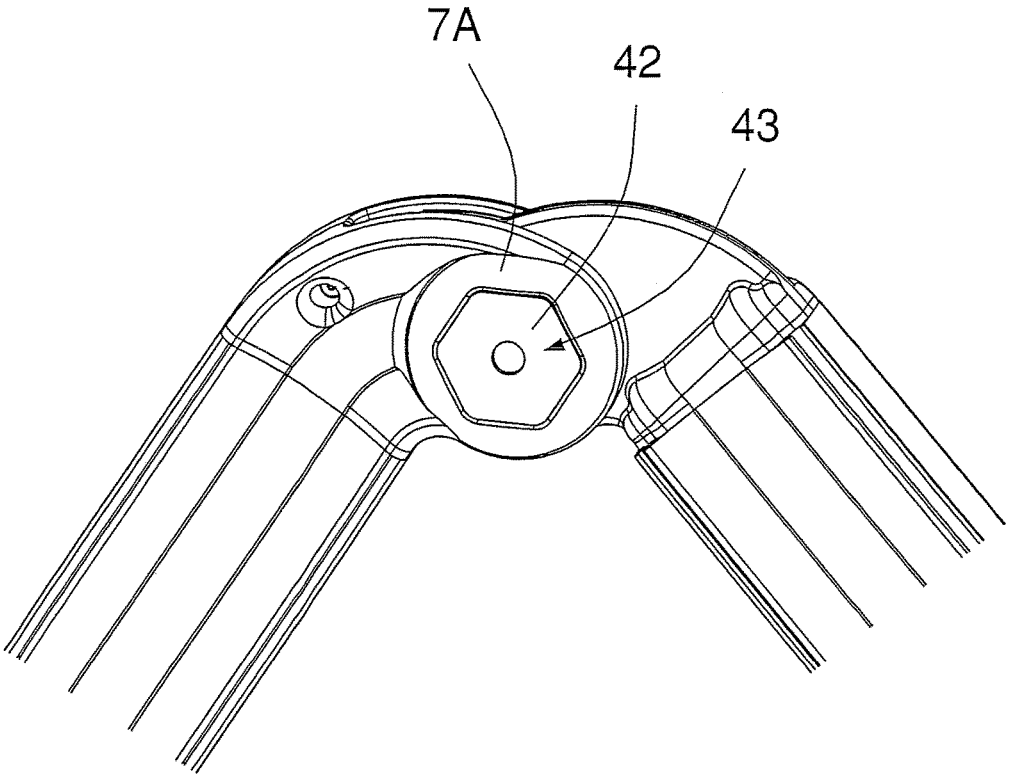
FIG. 13 shows a second joint according to the invention.

The shaft 36 in the first joint 7 comprises a screw 41 that passes through the first part of the joint 34 and the second part of the joint 35, which screw at one end 41*a* comprises an enlarged edged head 42, a hexagonal head, that when in its assembled condition is arranged in an indentation 43 that coincides in form with the outer surface 7A of the joint in order to achieve fixed contact with the joint 7 and in order to achieve distribution of the force that holds the joint together over a large part of the surfaces 38*a* and 39*a* of the joint. See FIGS. 12 and 13.

The shaft 36 comprises a nut 44 that is screwed onto the threaded second end 41*b* of the screw, and a washer 45 that distributes force is arranged between the nut 44 and the second side 7B of the joint.

The two parts 34 and 35 of the second joint are manufactured from a polymer material and are manufactured by casting in a mould.

One part 34 or 35 of one joint, in the embodiment shown this is part 34, the part that comprises a plane part 40, comprises an inner part 46, a reinforcement. The inner part 46 is of steel and it is fully or partially surrounded by the part of the joint 34 or 35, in polymer material.

The first part 34 of the second joint comprises a part 47 that protrudes from the second joint 7 and that makes it possible to assemble the first part of the joint 38 with the first arm section 3. The second part 35 of the second joint comprises also a part 48 that protrudes from the first [sic, "second"?] joint 7 and that makes it possible to assemble the second part of the joint 39 with the second arm section 4. The parts 47 and 48 have a form that makes it possible to introduce the part 47 and 48 into the profile of the first arm section and into the profile 9 of the second arm section. The parts 47 and 48 are held together with the aid of fixture means 47.1 and 48.1, through screws or bolts, in the relevant arm section 3 and 4. The fixture means 47.1 and 48.1, the bolts, are covered with the aid of a cover 49.

The Balance Arrangement:

The arrangement 1, the arm construction 1.1, comprises a balance arrangement 50 [sic, missing word "that"?] is arranged between the second joint 7 and the first arm section 3 and comprising a fixture means 51, a fixture disk, arranged around the axis 36 of rotation of the joint fixed attached to the outer surface 7B of the joint and comprising a part 52 that protrudes from the joint 7 and a tension construction 53, a gas spring, that is attached at one end 53*a* in a manner that allows rotation to the protruding part 52, its outer free part, and that is attached at its second end 53*b* in a manner that allows rotation to the first arm section 3. See FIG. 11.

The central line 52L of the protruding part has an angle $\alpha$, which lies within the interval 75°-105°, relative to a central line 4L of the arm section 4, the second arm section, that is fixed attached with the part of the joint 35, the second part of the second joint, to which the attachment means 51 is fixed attached. The interval of angles 80°-100° further ensures a better, more stable, function of the balance arrangement 50.

Figure 14:
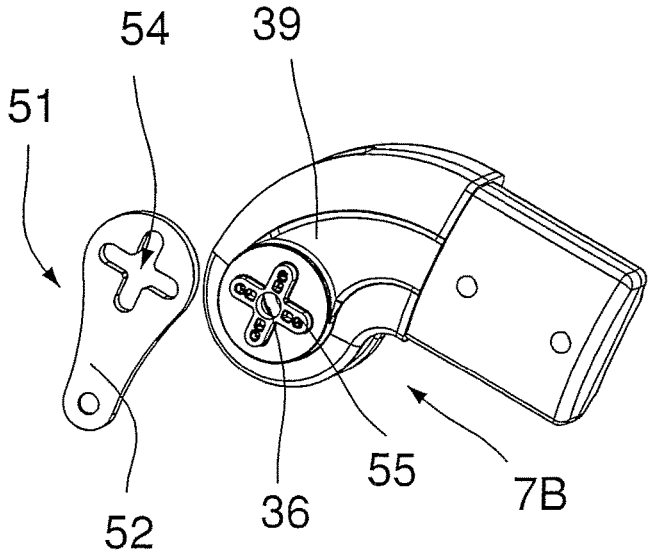
FIG. 14 shows a fixture means in a balance means at a second joint according to the invention.

The fixture means 51 comprises a through hole 54 through which the shaft 36 is to be placed and it has also a pre-determined form that is brought into interaction with a part 55 outwardly directed from the joint 7 arranged around the shaft 36, with a form that corresponds to the form of the hole, such that the position of the fixture means 51 is determined relative to the joint 7. See FIG. 14. The hole 54 and the outwardly directed part 55 have in the embodiment shown an interacting X-form such that the location of the fixture means, the fixture disk, can be changed by the release of the attachment means 51 from the outwardly directed part 55, rotation of the fixture means 51 relative to the outwardly directed part 55, and new interaction of the fixture means 51 and the outwardly directed part 55.

Figure 15:
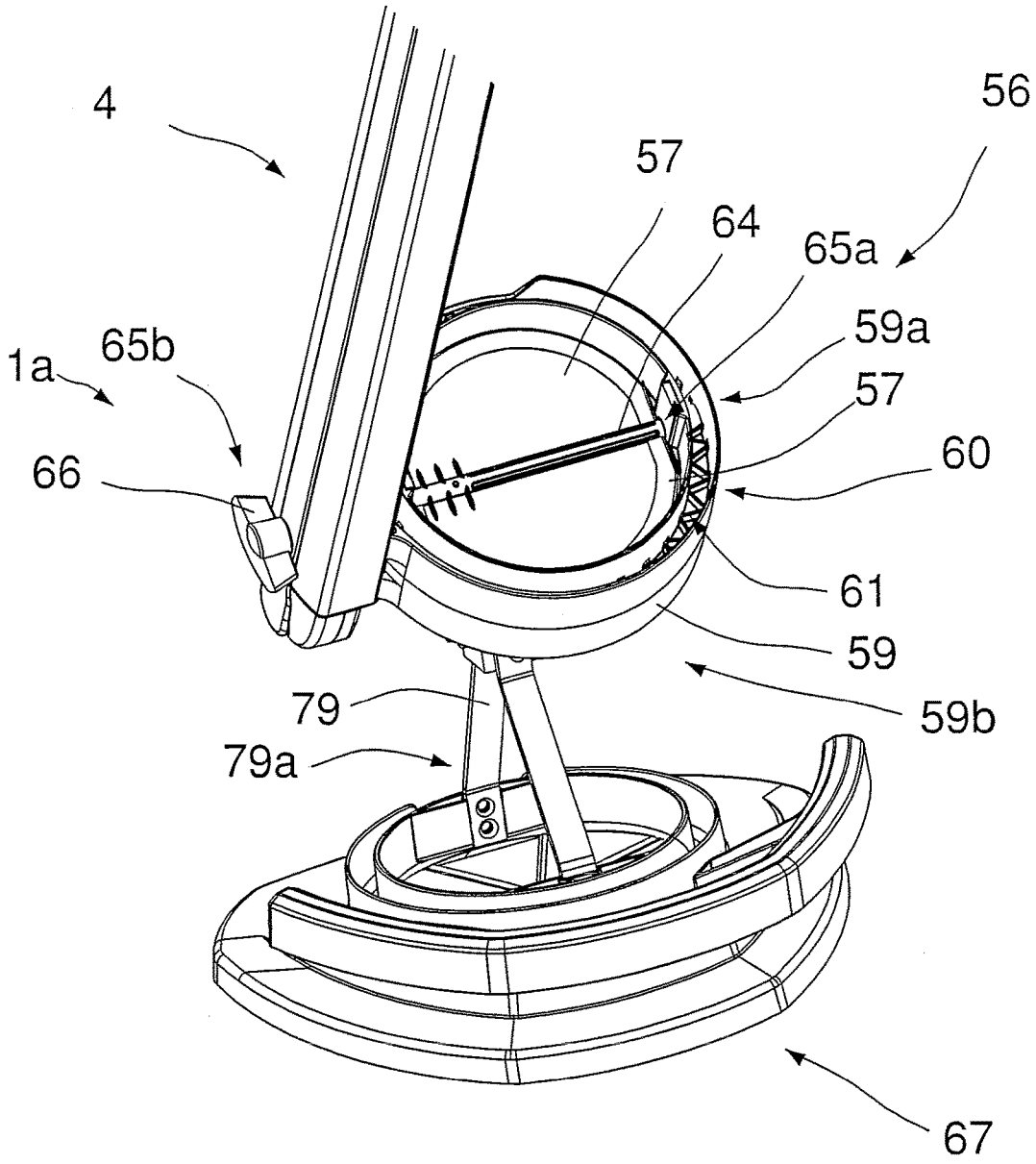
FIG. 15 shows an arm arrangement that comprises a baffle construction and that offers a fixture for the free end of an air channel, and a hood according to the invention.
Figure 16:
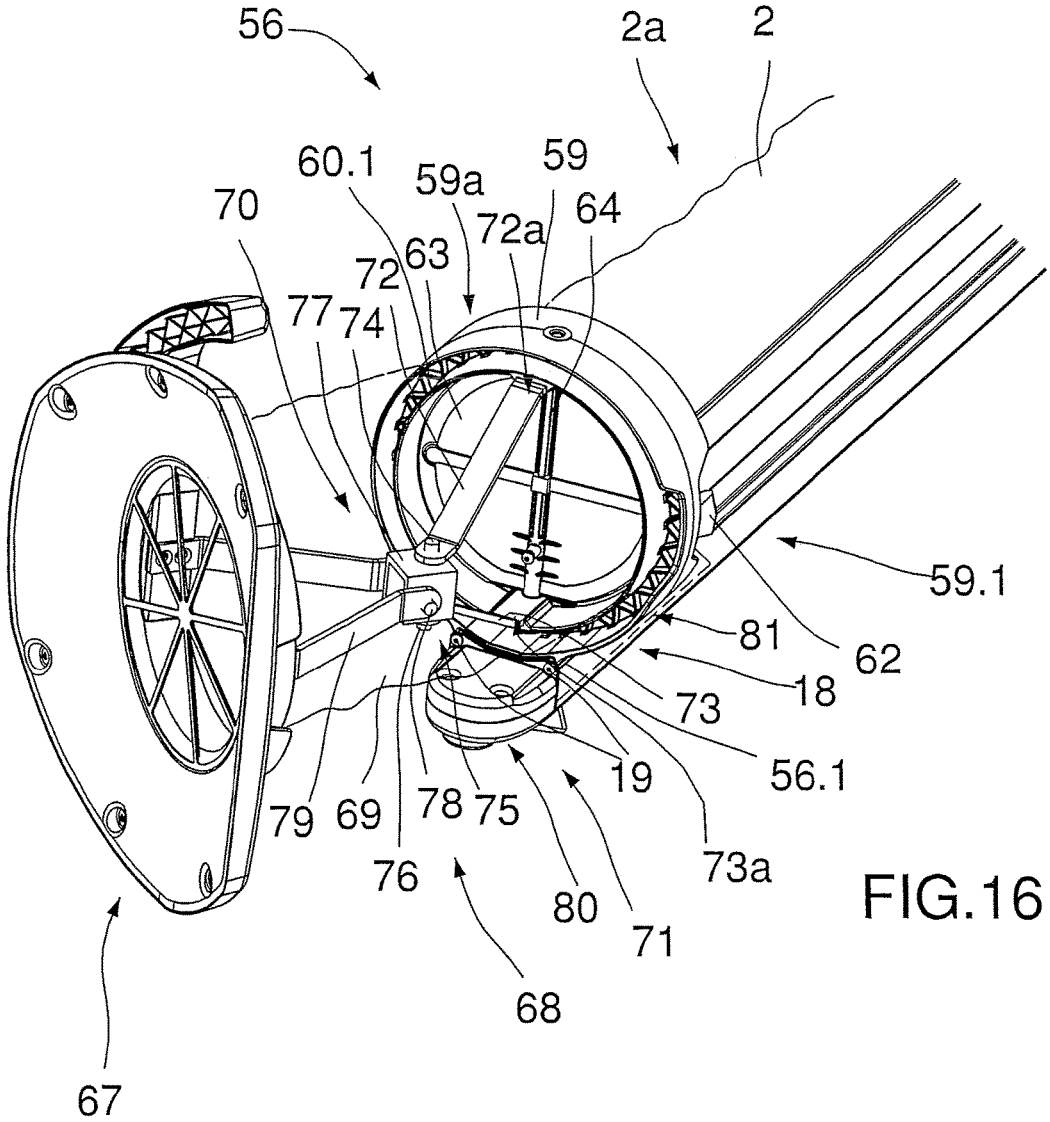
FIG. 16 shows an arm arrangement that comprises a baffle construction and that offers a fixture for the free end of an air channel, and a hood according to the invention.
Figure 17:
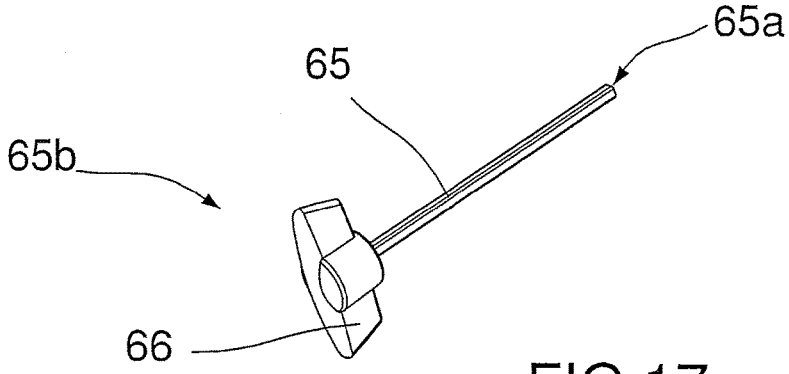
FIG. 17 shows a baffle regulator according to the invention.

The Arm Arrangement Comprising a Baffle Construction and Fixture:

The arrangement 1, the arm construction 1.1, comprises at the free end 1*a* of the arm construction an arm arrangement 56, attached to the outermost arm section 4, which arm arrangement comprises a baffle construction 57 and that offers a fixture, an area for mounting, for the free end 2*a* of the air channel. See FIGS. 1, 15 and 16.

The embodiment shown in the drawings has two arm sections 3 and 4. An arrangement according to the invention may comprise more arm sections and joints if it is necessary for the arm construction to be longer, or if it is desirable to be able to make further angle positions of the arm construction. The arm arrangement 56 is to be mounted at the arm section that is the outermost arm section, in the embodiment shown this will be arm section 4.

The arm arrangement 56 is attached to the outermost, the second, arm section 4 with the aid of a fixture arrangement 58 that comprises a fixture 18 at the arm section 4 and that unites the arm arrangement 56 with the arm section 4. See FIGS. 3 and 16. The fixture 18 comprises at least one track 19 that runs along the arm section 4 and in which track a part 56.1 of the arm arrangement 56 is arranged.

The track 19 and the arm arrangement part 56.1 have designs complementary to each other in such a manner that the arm arrangement part 56.1 can be introduced into the track 19 from one end of the arm 4*a* or 4*b*, the end of the track, and displaced along the track 19 to the desired location. The fixture 18 comprises two parallel tracks 19 that run along the arm section 4 and in which two arm arrangement parts 56.1 are arranged.

The arm arrangement 56 comprises a ring construction 59 with a limited extension in length that comprises at one of its ends 59*a* a mounting area 60 at which the flexible channel 2 is mounted in a manner that allows it to be detached. The mounting area 60 for the outermost end of the air channel 2 comprises a cavity 61 into which the end 2*a* of the channel is introduced and attached with the aid of a mounting arrangement 62. The ring construction 59 has an opening 59.1 at the edge of one end 59*a* that makes it possible to gain access to the mounting arrangement 62.

The baffle construction 57 comprises a plate 63 that is arranged inside the arm arrangement 56 such that it can pivot and that can be pivoted between a position in which the plate 63 is placed parallel with the arm 4 and offers full flow of air through the arm arrangement 56 and a position in which the plate 63 is located transverse to the arm arrangement 56 and cuts off the flow of air. [Two sentences had been mixed here, and text was missing from the second.] [The baffle construction] 57 makes it possible to regulate the flow of air in the flexible channel 2 and through the arm arrangement 56 from full flow of air to a cut-off flow of air, and flows of air that lay between these. The plate 63 comprises an edged channel 64 that runs transverse across the plate 63 in which an edged shaft 65 is arranged and where the shaft 65 runs through the arm section 4 and which is attached in a manner that allows rotation at one of its end 65*a* in the arm arrangement 56 and is attached in a manner that allows rotation at its second end 65*b* through the arm section 4 and is terminated by a knob 66 on the outer surface of the arm section 4 in order to control the position of the shaft 65 and thus also the position of the plate 61 [sic, "63"] and the passage of air.

The arm arrangement 56 comprises also a part 56A, a handle, that can be gripped by one hand and that can transfer a force from a person to the arrangement 1 such that the position of the arrangement 1, the arm construction 1.1, and the air channel 2 can be adjusted. This part 56A is shown only in FIG. 1.

The arm arrangement 56 is manufactured principally from a polymer material and it is manufactured by casting in a mould.

The Air Intake Arrangement:

The arrangement 1, the arm construction 1.1, comprises an air intake arrangement 67 whose position can be adjusted. The air intake arrangement 67 has the form of a hood, see FIGS. 1 and 15-17, that is united with the arm arrangement 56, and that is attached at the outermost arm section 4 of the arm construction and that comprises the baffle construction 57. The hood 67 is united with the arm arrangement 56 through a construction 68 that is arranged, fixed to, the arm arrangement 56 and inside the hood 67 and that is arranged inside a second air channel 69 that also is fixed to the arm arrangement 56 and in the hood 67, and where the construction 68 makes it possible to adjust the position, the angle, the tilt and the direction, of the hood 67 relative to the arm arrangement 56. The arm arrangement 56, its ring construction 59, comprises at its second end 59*b* a mounting area 60.1 where the second air channel 69 is fixed in a manner that allows it to be released.

The construction 68 comprises a joint system 70 that allows three-dimensional movement of the hood 67 relative to the arm construction 1.1, the arm arrangement 56, the air channel 2*a*. The construction 68 comprises a first fixture part 71, comprising two arms 72 and 73, diametrically arranged relative to each other and each attached at one of their ends 72*a* and 73*a* with the arm arrangement 56, and which combine at the joint system 70 and which there offer two fixture points 74 and 75 for a through shaft 76 around which a joint part 77, that comprises a further shaft 78, can be rotated and where a second fixture part 79, a third arm, is arranged to be rotated around the second shaft 78 and comprising a free end 79*a* onto which the hood 67 is mounted.

The first shaft 76 is arranged in one direction and the second shaft 78 is arranged in a direction displaced 90° relative to the first shaft 76, which results in the possibility of three-dimensional movement of the hood relative to the arm construction 1, the arrangement 56.

Other Components:

The fixture arrangement 6, and thus the complete arm construction 1.1, is attached to a wall, a floor, a ceiling or a free-standing, possibly mobile, unit.

The outermost free end 1*a* of the arm construction, the outermost end 4*a* of the second arm section, is terminated with a soft part 80. The soft part 80 is manufactured from a polymer material, through casting, and it comprises a part 81 that is introduced into the profile 9 of the arm section and mounted onto the arm section 4 with the aid of a shaft 65 that passes through the arm section 4, the shaft with which the baffle construction 57 is adjusted.

The arrangement 1, the arm construction 1.1, is intended to be used in a ventilation arrangement in order to hold and control an air channel 2 on the outer surface of the channel 2A, see FIG. 1, and with only a single arm construction 1.1.

An arrangement 1 according to this invention can be described based on the arrangement 1 also comprising the flexible channel 2. The invention concerns also a compete ventilation arrangement comprising an arrangement 1 with the design that has been described above. Also a complete ventilation arrangement will be easier to transport and mount if an arrangement 1 comprising an arm construction 1.1 is of this type.

The descriptions of various technical characteristics that are given in this description are to be interpreted in a manner that is advantageous to the invention, and not as limitations of the innovative concept. Different technical characteristics can be combined in various ways without deviating from the innovative concept, provided that the desired function is obtained.

The invention claimed is:

1. An arrangement for use in a ventilation arrangement in order to hold and control an air channel, the arrangement comprising:

a single arm construction that is arranged along an outer surface of the air channel, wherein the arm construction comprises two arm sections arranged one after the other, a first joint that unites a first arm section with a fixture arrangement that holds and maintains a basic position of the arm construction and that makes possible different positioning of the arm construction and the air channel, a second joint that unites the first arm section with the second arm section and that makes possible different positioning of the arm construction and the air channel, wherein each arm section comprises an extended aluminium profile, a balance arrangement that is arranged between one joint and one arm section, comprising a fixture arranged around an axis of rotation of the joint and attached at an outer surface of the joint, and comprising a part that protrudes from the joint, and a tension construction that is attached at one of its ends to the fixture in a manner that allows rotation to the protruding part of the fixture and attached at its other end directly to the arm section in a manner that allows rotation at the arm section, wherein a centre line of the protruding part has an angle in a range between 75°-105° relative to a centre line of the arm section that is attached to the part of the joint at which the fixture is attached, and wherein the fixture has a through hole through which a shaft is inserted, the through hole has a pre-determined shape and engages with a part outwardly protruding from the joint arranged around the shaft, and the outwardly protruding part has a shape that fits into the predetermined shape of the through hole such that the position of the fixture is determined relative to the joint.

2. An arrangement according to claim 1, wherein each arm section comprises a side that is turned to face the air channel and whose exterior has been formed into a concave design to support the air channel.

3. An arrangement according to claim 1, comprising another fixture arrangement that fixes and retains in place, the air channel at the arm construction.

4. An arrangement according to claim 3, wherein the another fixture arrangement comprises parts that are united with each arm section and that are held in tension around the air channel.

5. An arrangement according to claim 3, in which the another fixture arrangement comprises a fixture member on each arm section that unites the parts with the relevant arm section.

6. An arrangement according to claim 5, wherein the fixture member comprises at least one track that runs along the arm section, in which the parts, or a part of the relevant parts, are arranged.

7. An arrangement according to claim 1, wherein the first joint comprises a first part attached at the fixture arrangement and a second part attached at the first arm section and wherein the parts of the joint are united with each other through a shaft that passes through the first part of the joint and the second part of the joint, around which shaft the first part of the joint and the second part of the joint can be rotated relative to each other.

8. An arrangement according to claim 1, wherein the second joint comprises a first part attached at the first arm section and a second part attached at the second arm section and wherein the parts of the joint are united with each other through a shaft that passes through the first part of the joint and the second part of the joint around which shaft the first part of the joint and the second part of the joint can be rotated relative to each other.

9. An arrangement according to claim 7, wherein one of the parts of the joint arranged parallel to each other and separated by a distance, these parts being in turn arranged on each side of a plane part that is comprised within the second part of the joint.

10. An arrangement according to claim 9, wherein the two parallel parts each comprises a friction surface arranged on the surface of the relevant part that is facing the plane part of the second part of the joint.

11. An arrangement according to claim 10, wherein the two parallel parts, the surface of the relevant part, facing the plane part of the second part of the joint have a surface form that is concave.

12. An arrangement according to claim 7, where wherein the shaft comprises a screw that passes through the first part of the joint and the second part of the joint, which screw at one end comprises an enlarged edged head, a hexagonal head, that when in its assembled condition is arranged in an indentation that coincides in form in one side of the joint in order to achieve fixed contact with the joint and in order to achieve distribution of the force that holds the joint together over a large part of the surfaces of the joint.

13. An arrangement according to claim 7, wherein at least the two parts of one of the joints are manufactured from a polymer material.

14. An arrangement according to claim 7, wherein at least one part of the joint comprises an inner part reinforcement of steel.

15. An arrangement according to claim 7, wherein at least the two parts of one of the joints are manufactured through casting in a mould.

16. An arrangement according to claim 1, comprising an arm arrangement attached at the outermost arm section of the arm construction, and that comprises a baffle construction and that offers a mounting area of the free end of the air channel.

17. An arrangement according to claim 16, wherein the arm arrangement is fixed with an aid of a fixture arrangement comprising a fixture member on the arm section.

18. An arrangement according to claim 17, wherein the fixture member comprises at least one track that runs along the arm section and in which track a part of the arm arrangement is arranged.

19. An arrangement according to claim 16, wherein the baffle construction comprises a plate that is arranged such that it can be rotated inside the arm arrangement and that can be rotated between a position in which the plate is located parallel to the arm and offers full flow of air through the arm arrangement and the air channel, and a position in which the plate is located transverse to the arm arrangement and cuts off the flow of air, and all positions between these.

20. An arrangement according to claim 19, wherein the plate comprises an edged channel that runs across the plate in which an edged shaft is arranged and wherein the shaft is attached at one of its end in a manner that allows rotation in the arm arrangement, and is attached at its second end in a manner that allows rotation through the arm section and is there terminated with a knob in order to control the position of the shaft and thus of the plate and the passage of air.

21. An arrangement according to claim 16, wherein the arm arrangement comprises a part, a handle, that can-be gripped by one hand and that can transfer a force from a person to the arrangement such that the position of the arrangement, the arm construction, can be adjusted.

22. An arrangement according to claim 1, that comprises an air intake arrangement.

23. An arrangement according to claim 22, wherein the air intake arrangement is attached at an arm arrangement attached at the outermost arm section of the arm construction and that comprises a baffle construction.

24. An arrangement according to claim 23, wherein the air intake arrangement is attached at the arm arrangement through a construction that is arranged at, attached at, the arm arrangement and in the air intake arrangement and that is arranged inside a second channel that also is attached in the arm arrangement and at the air intake arrangement, and wherein the construction makes possible the adjustment of position of the air intake arrangement.

25. An arrangement according to claim 24, wherein the construction comprises a joint system comprising a first shaft and a second shaft wherein the second shaft is arranged in a direction displaced 90° relative to the first shaft, that allows three-dimensional movement of the air intake arrangement relative to the arm construction, the arm arrangement, the end of the air channel.

26. An arrangement according to claim 1, wherein the fixture arrangement is attached at a wall, a floor, a ceiling or a free-standing unit.

27. A ventilation arrangement comprising an arrangement according to claim 1.

* * * * *